US011698075B2

(12) United States Patent
Huang et al.

(10) Patent No.: US 11,698,075 B2
(45) Date of Patent: Jul. 11, 2023

(54) INFLATABLE PRODUCT HAVING ELECTRIC AND MANUAL PUMPS

(71) Applicant: Intex Marketing Ltd., Tortola (VG)

(72) Inventors: Zhi Xiong Huang, Fujian (CN); Ying Biao Zhang, Fujian (CN); Zheng Wen Lin, Fujian (CN)

(73) Assignee: Intex Marketing Ltd., Tortola (VG)

( * ) Notice: Subject to any disclaimer, the term of this patent is extended or adjusted under 35 U.S.C. 154(b) by 6 days.

(21) Appl. No.: 16/906,084

(22) Filed: Jun. 19, 2020

(65) Prior Publication Data

US 2020/0400150 A1 Dec. 24, 2020

(30) Foreign Application Priority Data

Jun. 21, 2019 (CN) ..... 201920947874.6
Jul. 11, 2019 (CN) ..... 201921084697.X

(51) Int. Cl.
*F04D 25/06* (2006.01)
*F04D 27/00* (2006.01)
*A47C 27/08* (2006.01)

(52) U.S. Cl.
CPC ..... *F04D 25/06* (2013.01); *A47C 27/082* (2013.01); *F04D 27/00* (2013.01)

(58) Field of Classification Search
CPC ..... A47C 27/082; F04B 1/00; F04D 25/06; F04D 27/00
See application file for complete search history.

(56) References Cited

U.S. PATENT DOCUMENTS 388,037 A 8/1888 Hargin
2,926,836 A 3/1960 Oliver et al.
(Continued)

FOREIGN PATENT DOCUMENTS

CN 2610763 Y 4/2004
CN 2611641 Y 4/2004
(Continued)

OTHER PUBLICATIONS

European search report dated Aug. 11, 2020 for EP Application No. 20181196.
(Continued)

*Primary Examiner* — David R Hare
*Assistant Examiner* — Alexis Felix Lopez
(74) *Attorney, Agent, or Firm* — Faegre Drinker Biddle & Reath LLP

(57) ABSTRACT

An inflatable product can be inflated to a low pressure by a lower-power but high-volume electric pump, then "firmed" or fully inflated by an auxiliary pump. The auxiliary pump may be manually powered, such that the overall cost and complexity of the electric and auxiliary pumps are still lower than a high-power electric pump. The low power high volume electric pump can be easily powered by small batteries that will also provide an increased number of inflations compared to traditional high-power pumps for a given battery capacity. Using small batteries allows the pump to be very compact in size. The auxiliary pump may work through an auxiliary air chamber within the primary air chamber and fluidly connected thereto by a check valve. The electric pump may be reversible to provide for both inflation and deflation.

18 Claims, 12 Drawing Sheets

(56) References Cited

U.S. PATENT DOCUMENTS 3,068,494 A * 12/1962 Pinkwater ..... A47C 27/081 5/708
3,112,502 A * 12/1963 Forsberg ..... A47C 27/081 5/708
3,155,991 A 11/1964 Dunham
4,504,989 A 3/1985 Maltz
4,619,481 A 10/1986 Grudzinskas
4,638,519 A 1/1987 Hess
4,711,275 A 12/1987 Ford et al.
4,768,249 A 9/1988 Goodwin
4,829,616 A 5/1989 Walker
4,890,344 A 1/1990 Walker
4,897,890 A 2/1990 Walker
4,944,060 A 7/1990 Peery et al.
5,020,176 A 6/1991 Dotson
5,044,029 A 9/1991 Vrzalik
5,142,717 A 9/1992 Everard et al.
5,235,713 A 8/1993 Guthrie et al.
5,249,319 A 10/1993 Higgs
5,349,983 A 9/1994 Ozarowski et al.
5,367,726 A 11/1994 Chaffee
5,509,154 A 4/1996 Shafer et al.
5,588,811 A 12/1996 Price
5,652,484 A 7/1997 Shafer et al.
5,711,041 A 1/1998 Chen
5,716,199 A 2/1998 Shan-Chieh
5,903,941 A 5/1999 Shafer et al.
5,904,172 A 5/1999 Gifft et al.
5,944,494 A 8/1999 Soltani et al.
6,032,080 A 2/2000 Brisbane et al.
6,037,723 A 3/2000 Shafer et al.
6,058,537 A 5/2000 Larson
6,158,082 A 12/2000 Beckey et al.
6,206,654 B1 3/2001 Cassidy
6,212,718 B1 4/2001 Stolpmann et al.
6,253,401 B1 7/2001 Boyd
6,483,264 B1 11/2002 Shafer et al.
RE37,983 E * 2/2003 Wang ..... A47C 27/084 417/478
6,623,249 B1 9/2003 Rogers et al.
6,686,711 B2 2/2004 Rose et al.
6,698,046 B1 3/2004 Wu
6,755,208 B2 6/2004 Chaffee
6,763,540 B1 * 7/2004 Wang ..... A47C 27/081 5/706
6,763,541 B2 7/2004 Mahoney et al.
6,928,681 B1 8/2005 Stacy
7,036,171 B2 5/2006 Wu
7,127,762 B1 * 10/2006 Lau ..... A47C 27/082 5/713
7,141,101 B2 11/2006 Amann
7,225,488 B2 6/2007 Wu
7,284,291 B2 * 10/2007 Wang ..... A47C 27/081 5/711
7,322,801 B2 1/2008 Li et al.
7,346,944 B2 3/2008 Shaw
7,434,283 B2 10/2008 Wilkinson et al.
7,444,704 B2 11/2008 Phillips et al.
7,648,392 B2 1/2010 Chambers et al.
7,784,132 B2 8/2010 Gonzalez et al.
7,789,194 B2 9/2010 Lathrop et al.
7,805,785 B2 10/2010 Rawls-Meehan
7,877,829 B2 2/2011 Gonzalez et al.
7,979,169 B2 7/2011 Rawls-Meehan
8,024,830 B2 9/2011 Wang et al.
8,032,263 B2 10/2011 Rawls-Meehan
8,032,960 B2 10/2011 Rawls-Meehan
8,046,117 B2 10/2011 Rawls-Meehan
8,078,336 B2 12/2011 Rawls-Meehan
8,078,337 B2 12/2011 Rawls-Meehan
8,125,318 B2 2/2012 Heimbrock et al.
8,162,009 B2 4/2012 Chaffee
8,336,369 B2 12/2012 Mahoney
8,413,278 B2 4/2013 Chaffee
8,561,230 B2 10/2013 Shaw
8,656,539 B1 2/2014 Boyd
8,678,007 B2 3/2014 Porter, III
8,682,457 B2 3/2014 Rawls-Meehan
8,745,796 B2 6/2014 Liu
8,769,747 B2 7/2014 Mahoney et al.
8,801,392 B2 8/2014 Wang et al.
8,832,886 B2 9/2014 Riley et al.
8,839,473 B1 9/2014 Catala
8,839,474 B2 9/2014 Chaffee
8,863,771 B2 10/2014 Wang et al.
8,893,339 B2 11/2014 Fleury et al.
8,931,329 B2 1/2015 Mahoney
9,211,018 B2 12/2015 Wang
9,211,019 B2 12/2015 Driscoll et al.
9,254,047 B1 2/2016 Schermel et al.
9,279,510 B2 3/2016 Chaffee
9,289,073 B2 3/2016 Chaffee
9,295,336 B2 3/2016 Driscoll et al.
9,314,105 B2 4/2016 Ralws-Meehan
9,729,430 B2 8/2017 Weinstein
9,879,682 B1 1/2018 Beliveau et al.
10,273,966 B2 * 4/2019 Lau ..... F04D 29/503
11,058,226 B2 * 7/2021 Hsu ..... F04B 39/123
2004/0123396 A1 * 7/2004 Wang ..... A45B 19/02 5/713
2004/0139551 A1 7/2004 Wang
2005/0079077 A1 * 4/2005 Tsai ..... A47C 27/082 417/423.15
2006/0037145 A1 2/2006 Wang
2006/0174416 A1 8/2006 Wu
2008/0047072 A1 * 2/2008 Chang ..... A47C 27/084 5/708
2011/0073202 A1 3/2011 Feingold et al.
2011/0259449 A1 10/2011 Wang et al.
2011/0284108 A1 11/2011 Wang et al.
2012/0304391 A1 12/2012 Driscoll et al.
2013/0134764 A1 5/2013 Groh
2013/0230410 A1 9/2013 Tsai
2014/0090176 A1 4/2014 Boyd
2014/0188285 A1 7/2014 Rawls-Meehan
2014/0250597 A1 9/2014 Chen et al.
2014/0259434 A1 9/2014 Nunn et al.
2014/0277611 A1 9/2014 Nunn et al.
2015/0026896 A1 1/2015 Fleury et al.
2015/0082547 A1 3/2015 Boyd
2015/0082548 A1 3/2015 Boyd
2015/0135444 A1 5/2015 Spahn et al.
2015/0157137 A1 6/2015 Nunn et al.
2015/0164236 A1 6/2015 Driscoll et al.
2015/0182033 A1 7/2015 Brosnan et al.
2015/0374137 A1 12/2015 Mahoney et al.
2016/0215780 A1 * 7/2016 Liu ..... F04D 29/4206
2017/0130728 A1 5/2017 Liu
2017/0202364 A1 7/2017 Ohno et al.
2017/0280884 A1 10/2017 Liu
2018/0335042 A1 11/2018 Lin et al.
2019/0269246 A1 * 9/2019 Youngblood ..... B63B 34/52

FOREIGN PATENT DOCUMENTS

CN 2746161 Y 12/2005
CN 2750081 Y 1/2006
CN 1260478 C 6/2006
CN 201090463 Y 7/2008
CN 201091399 Y 7/2008
CN 201273290 Y 7/2009
CN 201347870 Y 11/2009
CN 203516155 U * 4/2014 ..... F04D 29/053
CN 105283098 A 1/2016
CN 205064308 U 3/2016
CN 105952663 A 9/2016
CN 205744550 U 11/2016
CN 206183536 U 5/2017
CN 206649898 U 11/2017
CN 208456798 U 2/2019
CN 208822112 U 5/2019
CN 210446352 U * 5/2020 ..... F04B 33/00
DE 102006041332 B3 12/2007

(56) References Cited

FOREIGN PATENT DOCUMENTS

| | | | |
|---|---|---|---|
| EP | 3059451 | A1 | 8/2016 |
| JP | 07-054781 | A | 2/1995 |
| JP | 2013-127206 | A | 6/2013 |
| JP | 5929157 | B2 | 6/2016 |
| WO | 02/09554 | A1 | 2/2002 |
| WO | 02/15835 | A1 | 2/2002 |
| WO | 2017/064553 | A1 | 4/2017 |
| WO | 2017/132662 | A1 | 8/2017 |

OTHER PUBLICATIONS

Extended European Search Report in EP 20181196.5 dated Nov. 11, 2020, 14 pages.
International Preliminary Report on Patentability received for PCT Patent Application No. PCT/IB2016/001484, dated Apr. 26, 2018, 7 pages.
International Search Report and Written Opinion received for PCT Patent Application No. PCT/IB2016/001484, dated Feb. 23, 2017, 8 pages.
Supplemental European Search Report in EP16855009 dated May 13, 2019, 9 pages.
Yingyi Motor, Micro Air Pump (2004), 4 pages, www.yingyimotor.com/product/60423125783-801366169/Micro_Air_Pump_YYP370_XB2_DC3V_6V_9V_12V_24V.html, Nov. 12, 2019.

* cited by examiner

INFLATABLE PRODUCT HAVING ELECTRIC AND MANUAL PUMPS

CROSS-REFERENCE TO RELATED APPLICATIONS

The present application claims priority to Chinese Application No. CN201920947874.6 filed Jun. 21, 2019 and entitled INFLATABLE BED WITH TWO TYPES OF AIR PUMPS and Chinese Application No. CN201921084697.X filed Jul. 11, 2019 and entitled AN INTERNAL AND EXTERNAL AIR PUMP ASSEMBLY, the entire disclosures of which are hereby incorporated by reference herein.

BACKGROUND

1. Technical Field

The present disclosure relates to an inflatable product, in particular to an inflatable product including an electric air pump and an auxiliary air supply.

2. Description of the Related Art

Inflatable products, such as inflatable beds, inflatable rubber boats, etc., may be inflated by an electric air pump (either internal or external) or by a manual/foot-operated air pump (either internal or external). Many common inflatable products are inflated solely by electric air pump with sufficient power to ensure adequate inflation.

For example, many inflatable products require nominal inflation pressures above 180 mm WC. However, most electric air pumps operate at very poor efficiencies at this pressure. To overcome this deficiency, more power and design must be put into pumps. This, in turn greatly increases the cost of manufacturing and the power requirement for these electric pumps is high, particularly when using batteries to power the pump. On the other hand, if an inflatable product is large, using a manual air pump is very time-consuming and labor-intensive. This puts limitations on which consumers can even operate certain products.

What is needed is an improvement over the foregoing.

SUMMARY

The present disclosure provides an inflatable product which can be inflated to a low pressure by a lower-power but high-volume electric pump, then "firmed" or fully inflated by an auxiliary pump. The auxiliary pump may be manually powered, such that the overall cost and complexity of the electric and auxiliary pumps are still lower than a high-power electric pump. The low power high volume electric pump can be easily powered by small batteries that will also provide an increased number of inflations compared to traditional high-power pumps for a given battery capacity. Using small batteries allows the pump to be very compact in size. The auxiliary pump may work through an auxiliary air chamber within the primary air chamber and fluidly connected thereto by a check valve. The electric pump may be reversible to provide for both inflation and deflation.

In one form thereof, the present disclosure provides an inflatable product including a product body defining a primary inflatable chamber and having an electric pump aperture and an auxiliary air supply aperture formed therein; an electric air pump mounted on the product body through the electric pump aperture; and an auxiliary air supply mounted to the product body at the auxiliary air supply aperture, the auxiliary air supply defining an auxiliary air supply chamber defining an internal air volume nominally separate from, but contained within, the primary inflatable chamber of the product body.

In another form thereof, the present disclosure provides a method of inflating an inflatable product, including: using an electric air pump to inflate the inflatable product from a deflated state to a partially inflated state; and using an auxiliary air supply to supplement the air pressure developed by use of the electric air pump, to thereby inflate the inflatable product from the partially inflated state to a fully inflated state. The "fully inflated" state may be defined by a user's preference.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the disclosure in any manner.

DETAILED DESCRIPTION

Figure 1:
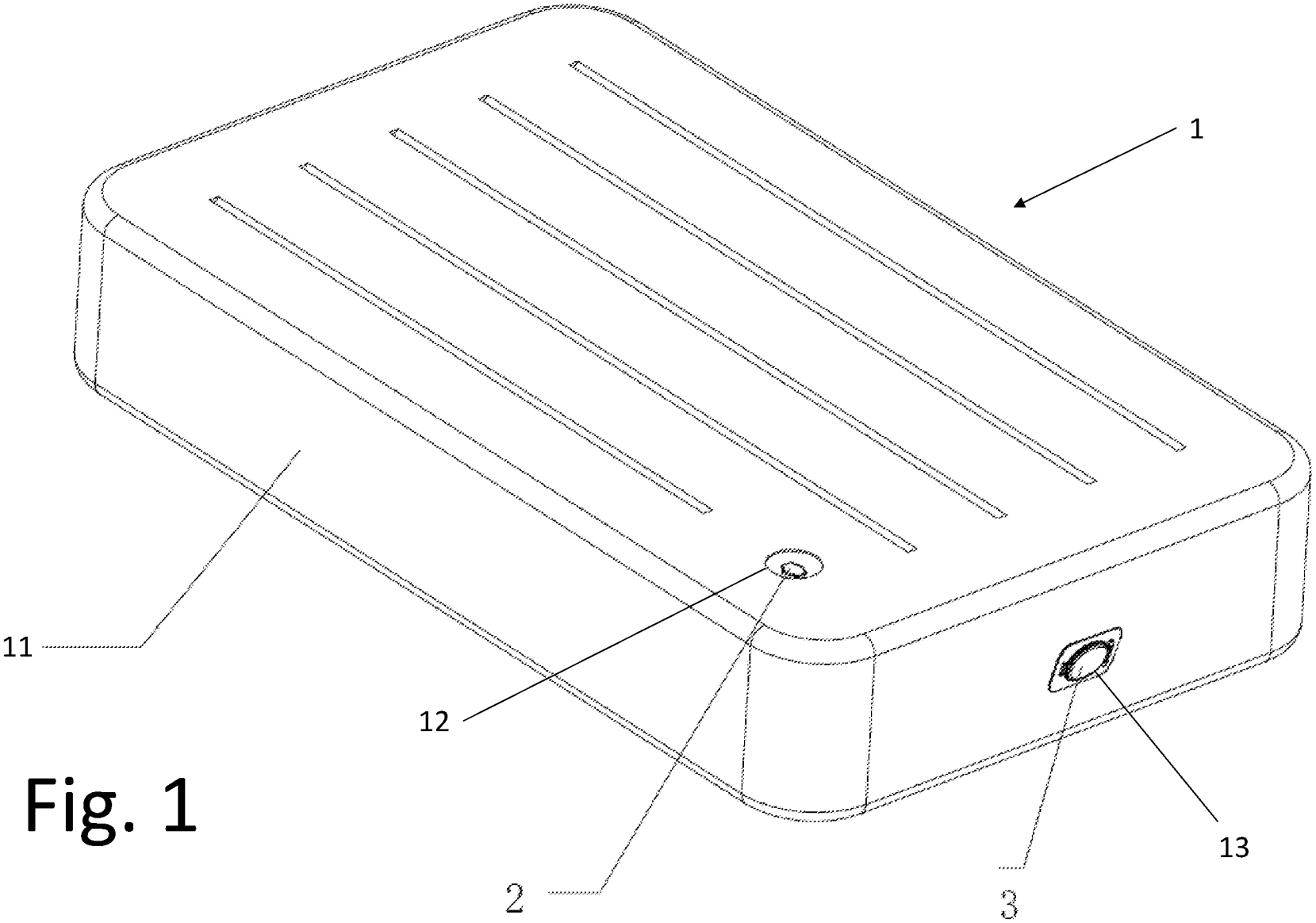
FIG. 1 is a perspective view of an inflatable product made in accordance with the present disclosure, including an electric air pump and an auxiliary air supply.

Turning now to FIG. 1, inflatable product 1 is shown as an inflatable mattress having a product body 11 defining a sealed, inflatable interior chamber as further described below. For the illustrated mattress, product body 11 includes bottom and top sheets designed to provide ground-contacting and sleeping surfaces, respectively, and a sidewall joined (e.g., by welding or other thermal fusing) to the peripheral edges of the top and bottom sheets. Inflatable product 1 may further include a set of tensioning structures contained within the inflatable chamber and fixed (e.g., by welding or other thermal fusing) to the top and bottom sheets to provide structure and maintain the mattress shape of inflatable product 1. Inflatable product 1 is shown and described for purposes of the present disclosure, it being understood that the principles of the present disclosure may equally be applied to other inflatable products such as inflatable pools and spas, inflatable floatation devices, and the like. One exemplary mattress which may be used in accordance with the present disclosure is described in U.S. Pat. No. 9,802,359, filed Jul. 28, 2014 and entitled METHOD FOR PRODUCING AN INFLATABLE PRODUCT, the entire disclosure of which is hereby incorporated herein by reference.

In the illustrated embodiment of FIG. 1, inflatable product 1 includes an auxiliary air supply 2 mounted to the top sheet of product body 11 at auxiliary air supply aperture 12. Auxiliary air supply 2 includes an auxiliary air supply wall 21 (FIG. 2), alternatively referred to herein as chamber 21 which is defined by its wall. Auxiliary air supply chamber 21 is nominally separate from, but contained within and in fluid communication with, the primary interior inflatable chamber of product body 11. In addition, an electric air pump 3 is mounted on product body 11 along a portion of the sidewall between the top and bottom sheets, through electric pump aperture 13.

In one exemplary operation of inflatable product 1, electric air pump 3 is used to inflate inflatable product 1 from a deflated state to a partially inflated state, then electric air pump 3 is turned off. Auxiliary air supply 2 is then used to supplement the air pressure developed by use of electric air pump 3, taking the inflated product 1 from the partially inflated state to the fully inflated state. In the fully deflated state, the volume of air within the chamber is zero or very close to zero, e.g., less than 5% of the nominal volumetric capacity of mattress 1. In the fully inflated state, the volume of air is sufficient to achieve a "firm" mattress 1, such as a pressure between 160-200 mm water column.

For example, if it is necessary to raise the air pressure in inflatable product 1 from 0 mm to 200 mm water column, electric air pump 3 may be used to initially inflate the interior chamber of product body 11 from 0 mm to a relatively low intermediate pressure, such as by delivering sufficient air to raise the internal pressure to between 15-25 mm water column (nominally 20 mm water column). This relatively low pressure can be delivered by a low-power, low-cost pump compared to electric pumps capable of delivering a full pressure of 160-200 mm water column. Although the air pressure capable of being generated by electric air pump 3 is relatively represents only 10% of the nominal target pressure, it represents a large percentage of the volume of air needed to fully inflate product 1, such as between 95.0% and 99.5% of the total air volume needed to inflate mattress 1 from a fully deflated state to a fully inflated state.

The percentage of the capacity of inflatable product 1 that is achievable for a given intermediate pressure capability of pump 3 may depend on the elasticity of the inflatable product. Relatively rigid, inelastic materials (e.g., reinforced materials used for inflatable spas) can be inflated from 20 mm water column to 200 mm water column with minimal volumetric expansion, such that only a small percentage of the total capacity is needed to raise the pressure. Conversely, relatively soft, elastic materials (e.g., materials used for inflatable mattresses such as mattress 1) may expand as the internal pressure increases, such that a relatively larger percentage of total capacity is needed to raise the pressure.

In order to achieve the fully inflated volume and pressure, the remaining 0.5-5.0% of the air volume of inflatable product 1 can be delivered by auxiliary air supply 2. At this point, most of the volume of air needed for full inflation is already contained within the inflatable chamber. For the illustrated embodiment of auxiliary air supply 2, discussed in more detail below, a small number of manual compressions may be sufficient to provide the final volume pumped air and thereby complete inflation to a fully inflated state. For purposes of the present disclosure, a "fully inflated" state of inflatable product 1 may correspond to a firm inflation pressure of 200 mm water column, it being understood that the final internal pressure may vary according to user preference. For auxiliary air supply 2, between 4-10 compressions may be required to increase the internal pressure from 20 mm water column to 200 mm water column. By contrast, if electric air pump 3 were not used and the full 200 mm water column were provided solely by auxiliary air supply 2, between 200 and 2000 manual compressions would be required.

Thus, in the present method in which the electric air pump 3 is first utilized to provide a large volume of air, and auxiliary air supply 2 is only used after electric air pump 3 has achieve a low pressure within the interior chamber, a low-power pump can be mated with minimal manual pumping to provide complete inflation. As an alternative to this "staggered" use of the two pump mechanisms, electric air pump 3 and auxiliary air supply 2 can also work simultaneously.

Figure 2:
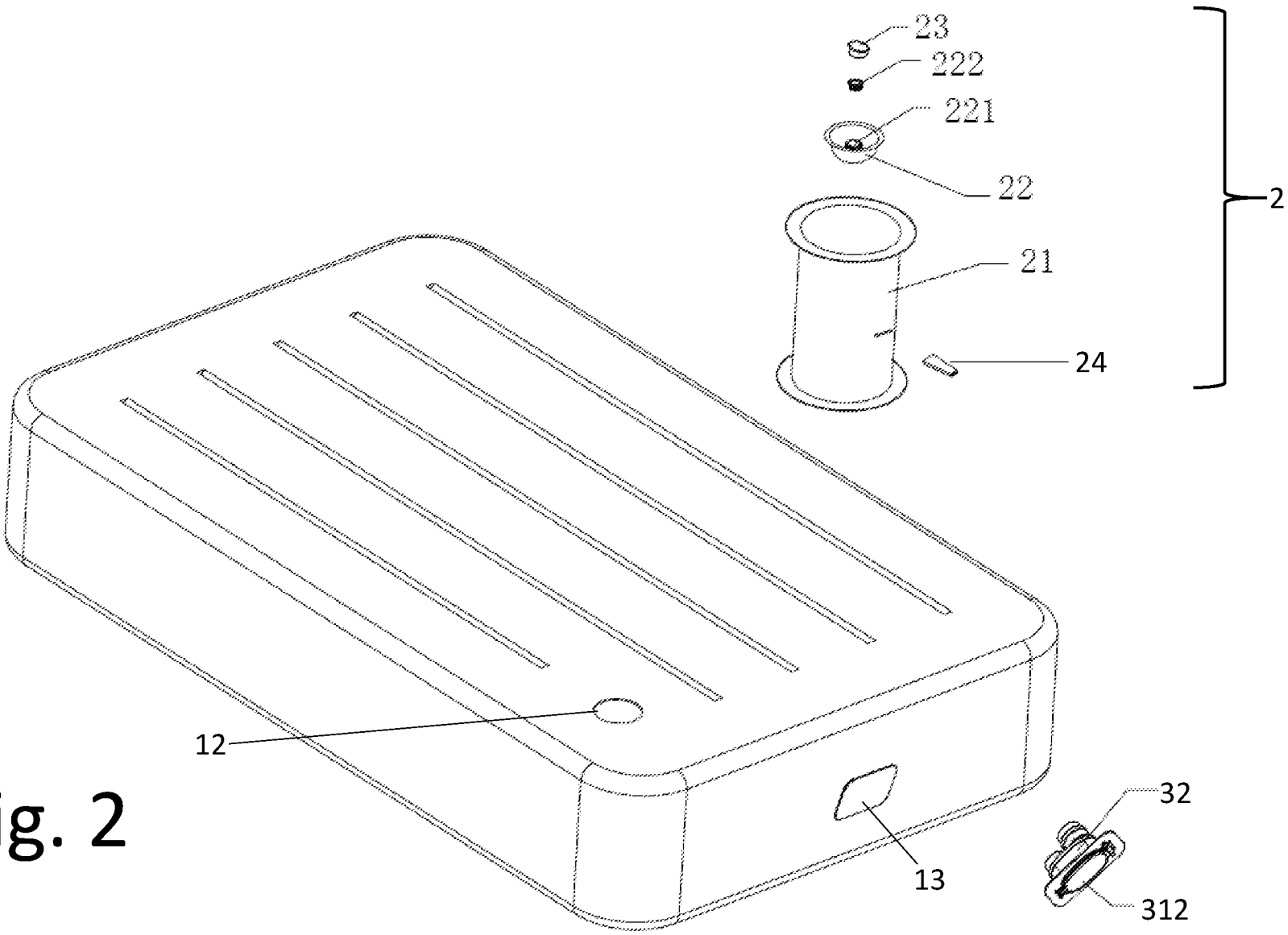
FIG. 2 is a perspective, exploded view of the inflatable product shown in FIG. 1.

Turning now to in FIG. 2, auxiliary air supply 2 includes an auxiliary air supply chamber 21, a valve 22, a valve cover 23, which cooperate to provide inflation air to the interior of auxiliary air supply chamber 21 via a manual input of the operator.

Figure 3:
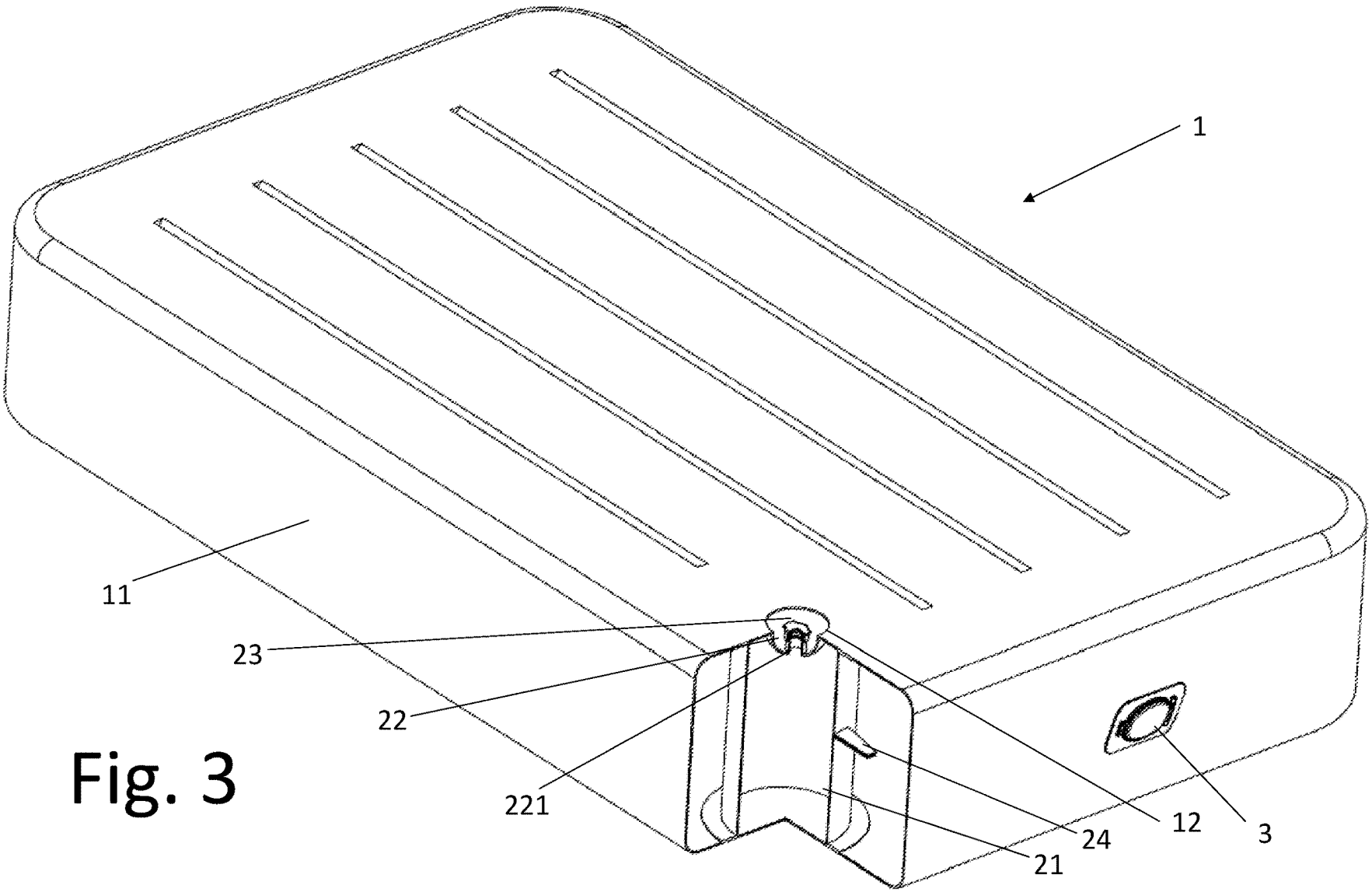
FIG. 3 is a perspective, partial cross-sectional view of the auxiliary air supply of the inflatable product shown in FIG. 1.

In the exemplary embodiment shown in FIG. 3, auxiliary air supply wall 21 is cylindrical in shape and is comprised of two ends which are sealingly connected to the top and bottom sheets of product body 11. The upper and lower openings of auxiliary air supply wall 21 are flared radially outwardly to form upper and lower peripheral seams which are sealingly connected to the inner wall of the top and bottom sheets of product body 11, respectively. In this way, the interior volume of internal air supply chamber defines an internal air volume nominally separate from, but contained within, the primary interior inflatable chamber of product body 11.

FIG. 2 shows valve 22 and valve cap 23 of auxiliary air supply 2. In the illustrated embodiment, valve 22 is shown having a half-spherical hollow "bowl" shape, though it is contemplated that valve 22 could have other shapes. Valve 22 includes air inlet 221 which is an aperture in the center of valve 22. Valve 22 creates fluid communication between the external or ambient environment and the interior of auxiliary air supply chamber 21. As shown in FIG. 3, the top of valve 22 is sealingly connected to the top sheet of product body 11 around the periphery of auxiliary air supply aperture 12. In this way, the interior of auxiliary air supply chamber 21 can receive or discharge air through air inlet 221.

As shown in FIG. 2, auxiliary air supply 2 also includes valve cover 23, seal 222, and check valve 24. Valve cover 23 is removably sealingly engaged with the air inlet 221 such that valve cover 23 may be used to close air inlet 221 on valve 22 to prevent air flow through valve 22. Valve cover 23 may be coupled to air inlet 221 by threaded rotation, a snap fit, or any other suitable method of sealingly coupling. In the illustrated embodiment, seal 222 is disposed between valve cover 23 and air inlet 221.

Auxiliary air supply chamber 21 includes check valve 24, shown in FIGS. 2 and 3. Check valve 24 is operably coupled to and passes through auxiliary air supply wall 21 and is configured to provide one-way fluid communication from auxiliary supply chamber 21 to the primary air chamber of inflatable product 1.

During operation, electric air pump 3 is used to inflate inflatable product 1 from a deflated state to a partially inflated state, then electric air pump 3 is turned off. The user then opens valve cover 23 and removes seal 222 thus allowing the chamber 21 to expand and fill with air. The user then covers the air inlet 221 with his or her hand or foot and presses downward on the air supply 2 to force air through check valve 24 causing additional inflation of the primary chamber of inflatable product 1. The user continues compressions of air supply 2 until the desired internal air pressure is achieved. When the user removes his or her hand or foot from air inlet 221, seal 222 may close to prevent any escape of air from auxiliary supply chamber 21. In this way, the auxiliary inflation function of auxiliary air supply 2 is realized.

Turning again to FIG. 1 and as noted above, inflatable product 1 also includes electric air pump 3. An exemplary embodiment of electric air pump 3 is shown in FIGS. 4-12. As illustrated, air pump 3 comprises a valve 31 (FIG. 4) and a pump 32 (FIG. 5). As described in further detail below, valve 31 includes valve cover 312 used to open (FIG. 10) or close (FIG. 9) airflow aperture 351 of valve base 311, and pump 32 is detachably coupled to valve 31 in either an inflation configuration (FIG. 7) or a deflation configuration (FIG. 8).

Figure 4:
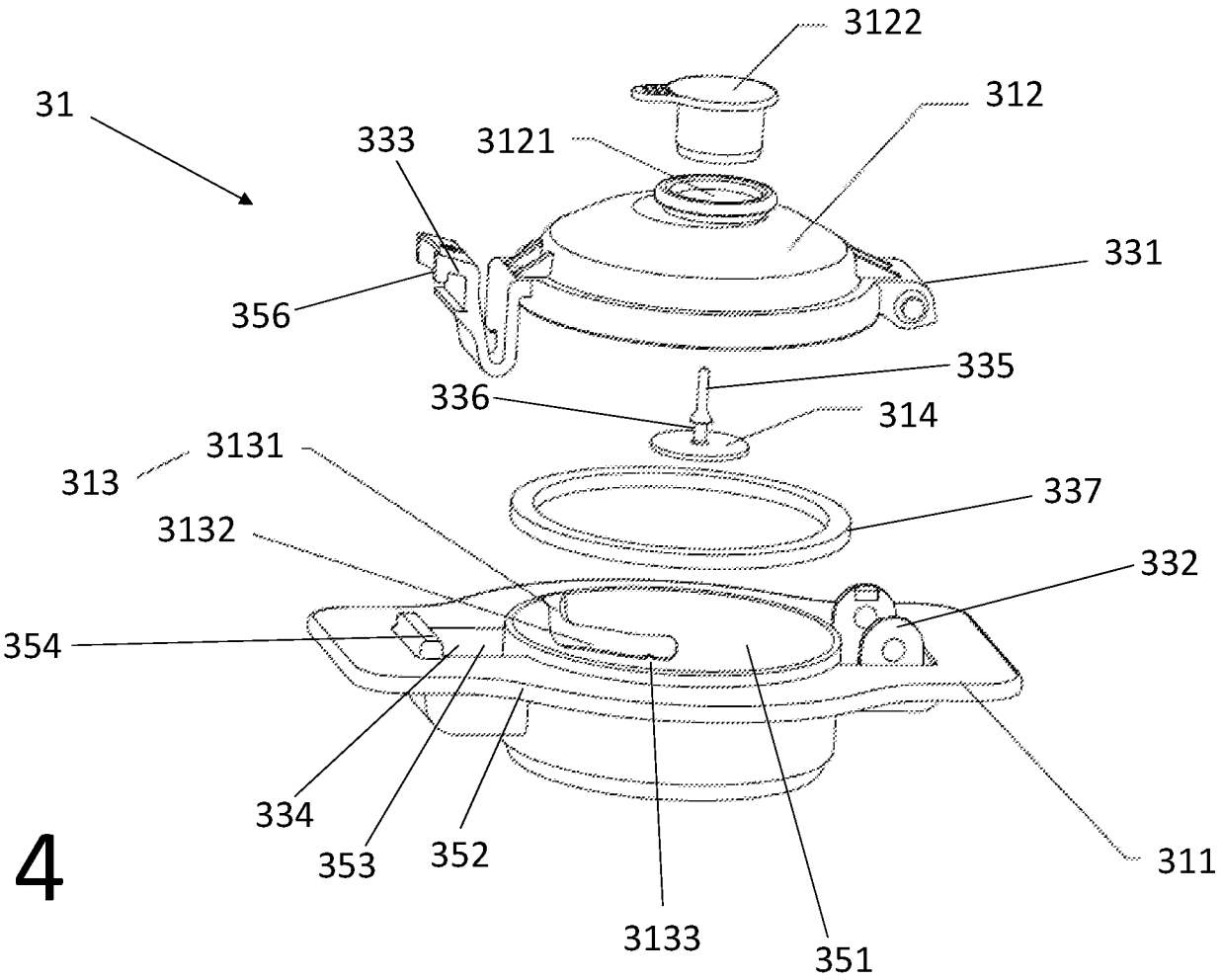
FIG. 4 is a perspective, exploded view of a valve of the air pump of the inflatable product shown in FIG. 1.
Figure 5:
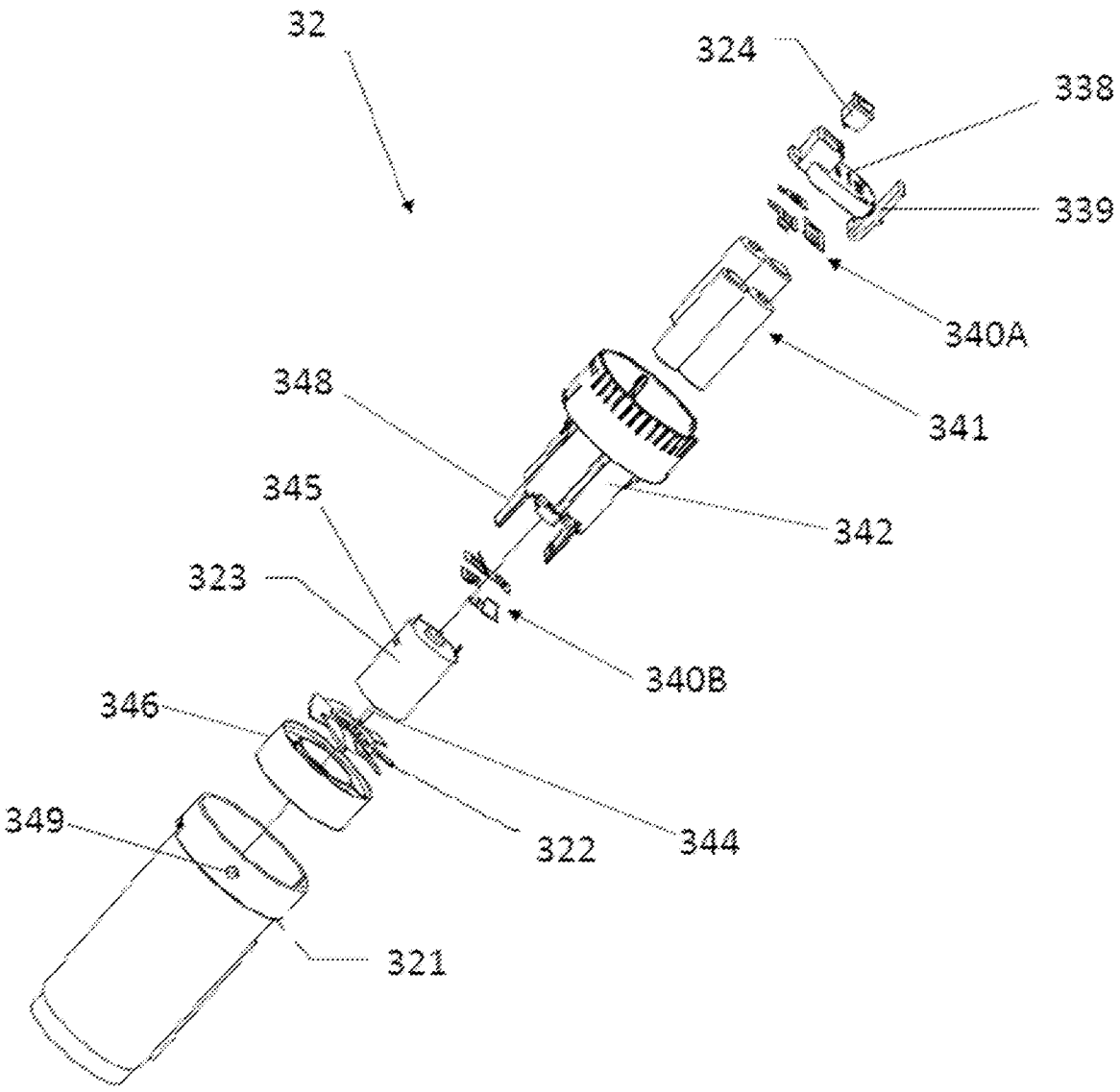
FIG. 5 is a perspective, exploded view of a pump of the electric air pump of the inflatable product shown in FIG. 1.
Figure 9:
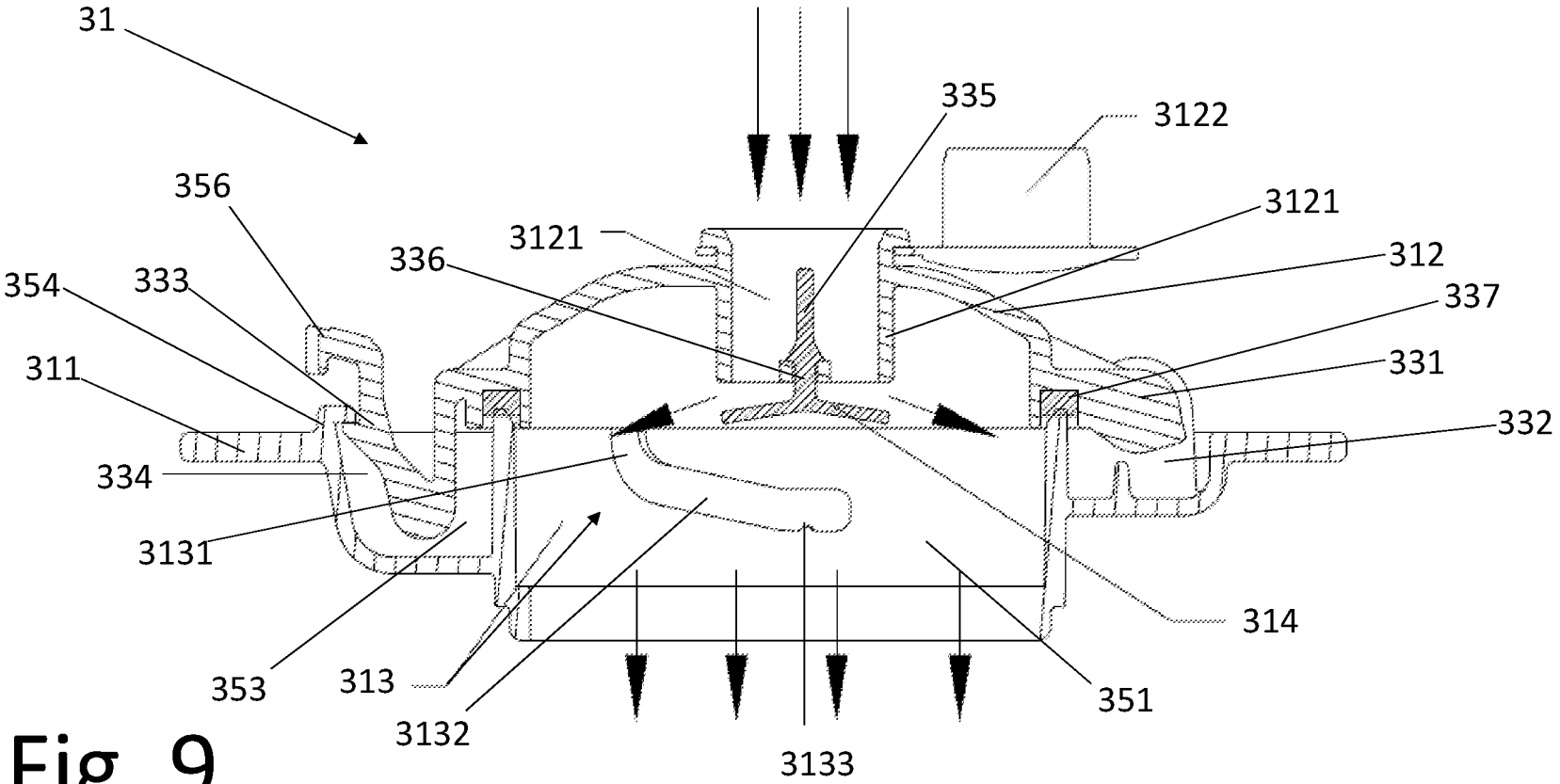
FIG. 9 is an elevation, cross-sectional view of the valve shown in FIG. 4, shown in a closed configuration.
Figure 10:
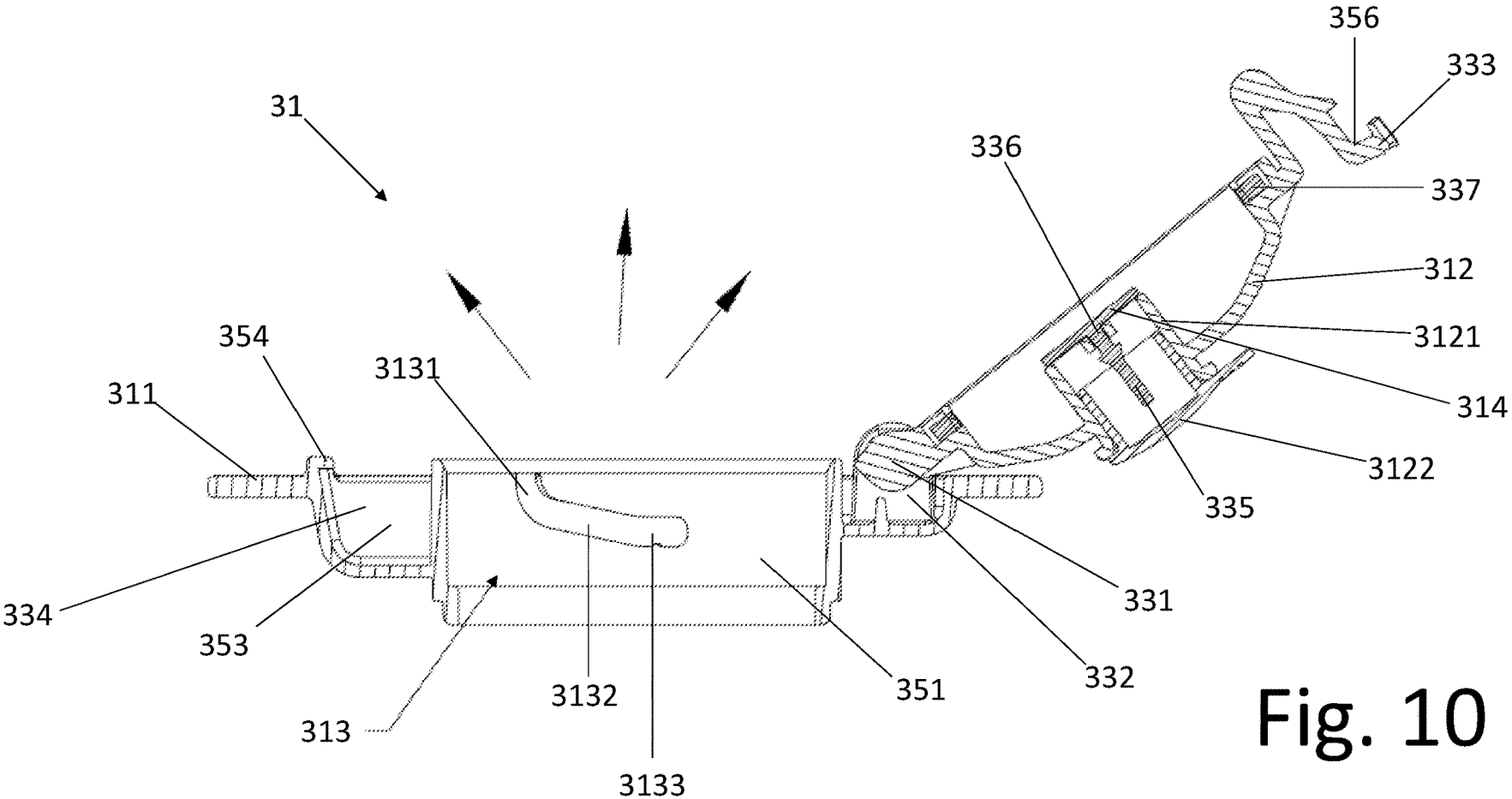
FIG. 10 is an elevation, cross-sectional view of the valve shown in FIG. 4, shown in an opened configuration.

Referring now to FIGS. 4 and 9-10, valve 31 includes valve base 311 and valve cover 312. As shown in FIG. 4, valve base 311 includes a through aperture 351 and a rim 352. Rim 352 surrounds through aperture 351 and extends radially outward therefrom. Rim 352 includes clip retainer 334. As best seen in FIG. 10, clip retainer 334 includes cavity 353 and lip 354. Cavity 353 extends radially out from through aperture 351 and down to create an open space. Lip 354 extends radially inward from rim 352 towards through aperture 351, and extends over cavity 353 to create a partial enclosure around cavity 353.

Opposite clip retainer 334 and shown in FIG. 4, is hinge receiver 332. Hinge receiver 332 is constructed of two vertical extensions, each with an aperture configured to rotatably receive a hinge.

FIG. 4 also shows that through aperture 351 extends vertically down beyond rim 352 and includes mounting groove 313. Mounting groove 313 is a slot that is cut out of the wall of through aperture 351. Mounting groove 313 is comprised of a first portion 3131, a second portion 3132 and a locking protrusion 3133. First portion 3131 extends axially (in the context of FIG. 4, vertically) down from a top lip of the wall of through aperture 351. First portion 3131 extends downwardly into a turn and leads into second portion 3132. Second portion 3132 extends horizontally (i.e., circumferentially) around a portion of through aperture 351. At an end portion of groove 313 along second portion 3132, locking protrusion 3133 extends vertically up from a lower surface of second portion 3132. Locking protrusion 3133 is configured to provide a bump or traversable impediment to passage of a protrusion sliding into the end of second portion 3132, as described further below.

Referring still to FIG. 4, the illustrated valve cover 312 is hemispherical in shape and roughly matches the circumference of through aperture 351. Valve cover 312 includes hinge 331, clip 333 and sealing cap 3122. Clip 333 extends radially outward from valve cover 312 and vertically down, then curves vertically up to a height above a bottom surface of valve cover 312. Located on the outward-most extension of clip 333 is arm 356. Arm 356 is an extension from clip 333 that slopes gradually out from clip 333 to a steep end. Arm 356 is a terminal end of clip 333 that extends radially outward from clip 333 and down such that it can cooperate with clip retainer 334, which creates a clamp mechanism to prevent lateral movement. In particular, clip 333 is semi-flexible and resiliently deformable in a radial direction such that upon insertion into clip retainer 334, clip 333 flexes radially in to fit within clip retainer 334 and then snaps radially out to lock arm 356 under lip 354.

Opposite of clip 333 and shown in FIG. 4 is hinge 331. Hinge 331 is sized and configured to be rotatably received within hinge receiver 332 via an axle or another suitable rotatable coupling. Gasket 337 is mounted to valve cover 312 around the circumference of valve cover 312 within a cavity which holds gasket 337 in place. Gasket 337 rests upon an upper surface of through aperture 351 when valve cover is pivoted to a closed configuration (FIG. 9).

Valve cover 312 also includes air inlet 3121 which is an aperture in valve cover 312 that provides communication between the external environment and the inner chamber of inflatable product 1. Fitting within air inlet 3121 is cap 3122 which is designed to provide an air-tight seal over air inlet 3121. Inlet 3121 leads to check valve 314. Check valve 314 includes a stem 335 which extends up from check valve 314 and into valve 31. At a bottom end of stem 335 is groove 336. Groove 336 is a thin portion of stem 335 terminating on one end by check valve 314 and at the other end with a radial extension of stem 335. As shown in FIGS. 9 and 10, groove 336 is configured to lock check valve 314 into place while check valve 314 is configured to fit within and sealingly engage an aperture in the middle of air inlet 3121. Groove 336 slidably holds check valve within air inlet 3121.

During inflation with a separate manual pump (not shown), when air is being pumped through inlet 3121, check valve 314 is urged open by the air flow and pressure, which allows air to be pumped into the internal chamber of inflatable body 11 (FIG. 9). Conversely, if cap 3122 is left off and valve cover 312 is closed, but no air is being pumped through inlet 3121, the air pressure inside the internal chamber of inflatable body 11 will push air into check valve 314, causing it to close and seal to prevent escape of the air within inflatable product 1.

FIG. 9 shows valve 31 in a closed configuration. In the closed configuration, valve cover 312 is rotated about hinge 331 towards valve base 311 and pressed against valve base 311 such that clip 333 flexes into and snaps beneath clip retainer 334 to removably lockingly engage cover 312 in the closed configuration. In this closed configuration, air can only flow through air inlet 3121 and can only flow through air inlet 3121 if cap 3122 is unsealed.

FIG. 10 shows valve 31 in an open configuration. In the open configuration, valve cover 312 is rotated about hinge 331 away from valve base 311 and air can flow freely through aperture 351. To transition from the closed configuration to the open configuration, arm 356 is pulled radially in towards through aperture 351 to flex clip 333 and provide clearance to lift clip 333 out of clip retainer 334 and rotate valve cover 312 about hinge 331 away from valve base 311.

Although a rotatable connection is illustrated, valve cover 312 and valve base 311 can also be provided as two separate and independent parts. When valve base 311 needs to be closed, valve cover 312 is attached to valve base 311 and when valve base 311 needs to be opened, valve cover 312 is removed from valve base 311.

Figure 6:
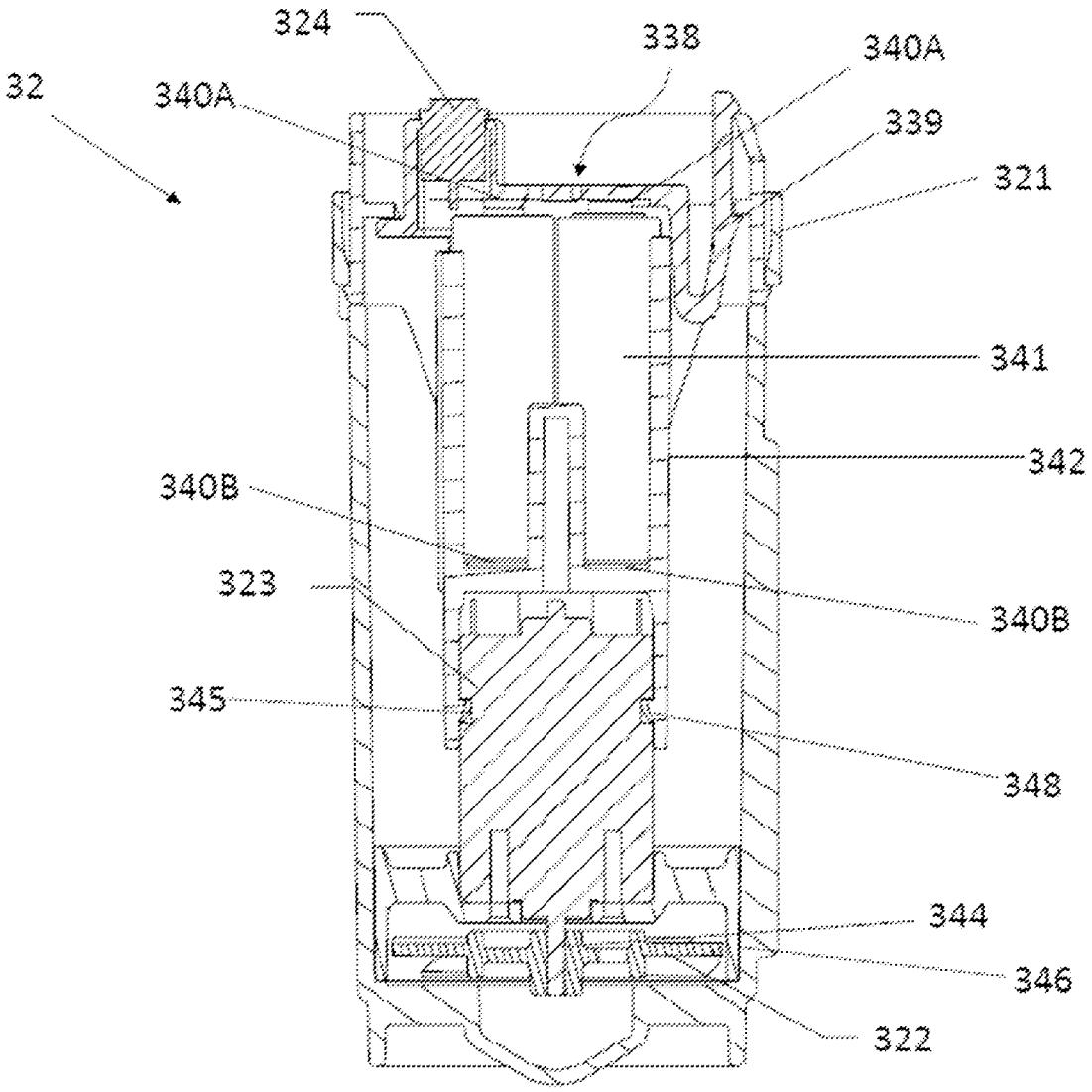
FIG. 6 is a cross-sectional view of the pump shown in FIG. 5.

As mentioned above and as shown in FIGS. 5-8 and 11-12, electric air pump 3 also includes pump 32. As shown in FIG. 5, pump 32 includes switch 324. In the current embodiment switch 324 is a rocker switch; however, switch 324 could take form of a push button switch, a rotary switch, a switch socket panel, or any other type of suitable switch. Also shown in FIG. 5 is user interface 338, which is configured to electrically receive switch 324 and include an indicator to indicate if the switch is turned on or off. FIG. 6 shows switch 324 coupled to user interface 338. As shown in FIGS. 5 and 6, user interface 338 includes clip 339, which is a semi-flexible and resilient extension of user interface. Clip 339 is configured, as shown in FIG. 6, to couple user interface 338 to pump 32.

Also shown in FIGS. 5 and 6 and coupled to a bottom surface of user interface 338 are power supply fittings 340A which are configured to provide electrical communication between user interface 338 and a power supply such as power supply 341. Also shown in FIG. 5, pump 32 includes power supply housing 342, which is configured to house power supply 341. In the current embodiment, power supply 341 is batteries, such as AA, AAA, or 9V batteries; however, power supply 341 could be a power cord configured to plug into an electrical socket, or any other suitable power supply. Furthermore, on a bottom surface of power supply housing 342 are a second set of power supply fittings 340B, which are configured to provide electrical communication between user interface 338, power supply 341 and a motor, such as motor 323.

Referring still to FIG. 5, motor 323 is configured to be in electrical communication with power supply 341 through power supply fittings 340B. As shown in FIG. 6, motor 323 is also configured to be coupled to power supply housing 342 via at least two latch arms 348 which are extend vertically down from power supply housing 338 and include prongs at their ends. Latch arms 348 are configured to removably latch onto a motor, such as motor 323 (FIG. 6). In particular, latch arms 348 latch onto motor 323 at grooves 345 on either side of motor 323. Grooves 345 are small cut-outs on an outer surface of motor 323 that reversibly receive the prongs of latch arms 348.

Figure 11:
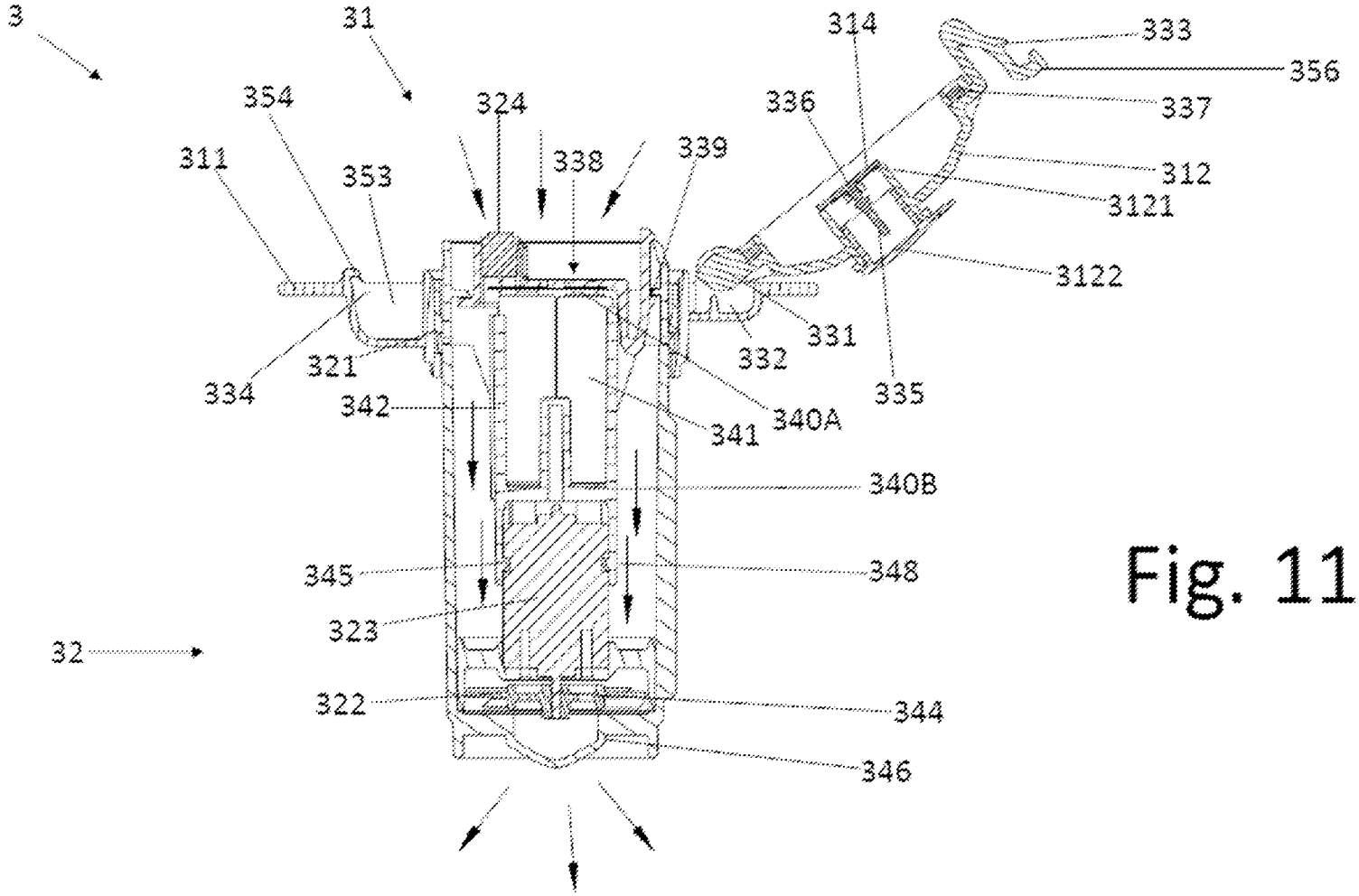
FIG. 11 is an elevation, cross-sectional view of the electric air pump of the inflatable product shown in FIG. 1, shown in an inflation configuration.
Figure 12:
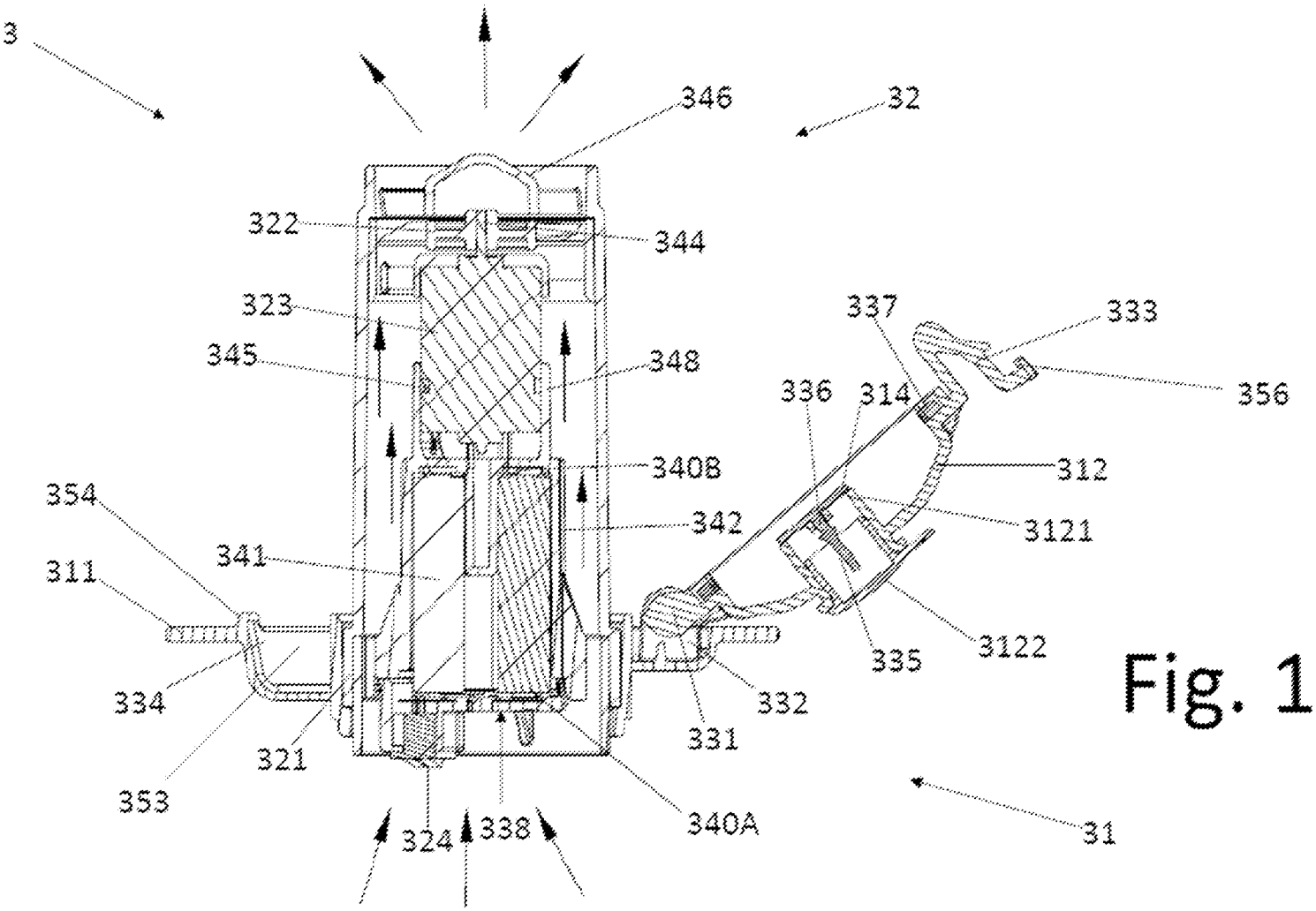
FIG. 12 is an elevation, cross-sectional view of the electric air pump of the inflatable product shown in FIG. 1, shown in a deflation configuration.

Motor 323 also includes output shaft 344 which is configured to be rotatably driven by motor 323. Coupled to an end of output shaft 344, and shown in FIGS. 5 and 6, is fan 322. Fan 322 is drivingly coupled to output shaft 344 and is configured to suck air or other inflation gas from one end of air pump 32 along the axial direction, and then release the air out from the other end along the axial direction. Fan 322 and motor 323 are arranged along the axial direction of air pump 32, and two ends of air pump 32 along the axial direction act respectively as the air inlet and the air outlet. Air pump 32 comprises an air passage outside fan 322 and motor 323 that connects the air inlet and the air outlet (FIGS. 11 and 12). In this way, the smooth movement of the air is achieved along the axial direction without obstruction.

Also shown in FIG. 5 is baffle 346. Baffle 346 is coupled to pump 32 on an opposite side of fan 322 from motor 323. Baffle 346 is configured to provide a safety buffer between the outside environment and fan 322, preventing spatial conflict of outside items with the fan blades while still allowing for air to flow through baffle 346.

Lastly, as shown in FIGS. 5 and 6, pump 32 includes housing 321 configured to house and contain baffle 346, fan 322, motor 323, and power supply housing 342, with user interface 338 acting as a cap of housing 321. Housing 321 includes an upper end and a lower end. The upper end of housing 321 includes a wider circumference than the lower end and is configured to fit within through aperture 351. As shown in FIG. 5, housing 321 includes peg 349. Peg 349 is cylindrical in shape and extends radially out from an outer surface of the upper portion of housing 321. Peg 349 is configured to slidably and reversibly fit with and engage mounting groove 313, described above.

During installation, housing 321 is first inserted into mounting groove 313 by aligning peg 349 with first portion 3131 by sliding peg 349 into first portion 3131. Then pump 32 is axially advanced by sliding housing 321 through aperture 351, guided by the interaction between peg 349 and first portion 3131 of groove 313, until peg 349 of housing 321 enters the connection between first portion 3131 and second portion 3132. At this time, pump 32 is rotated to make peg 349 enter second portion 3132. Finally, pump 32 is rotated further such that peg 349 is slid across the length of second portion 3132 and over locking protrusion 3133. At this point, peg 349 is locked into place within mounting groove 313. When electric air pump 3 is to be disassembled, or a change in configuration is needed, it is only necessary to rotate pump 32 in the reverse direction to unlock peg 349 from locking protrusion 3133, and continue to rotate and lift pump 32 from mounting groove 313. Because pump 32 and valve 31 are detachably connected together, the user can choose to install pump 32 on valve 31 to form a built-in electric air pump 3, or remove pump 32 from valve 31 to form an external electric air pump 3. Users can switch between these two modes at will according to their needs and usage scenarios.

Figure 7:
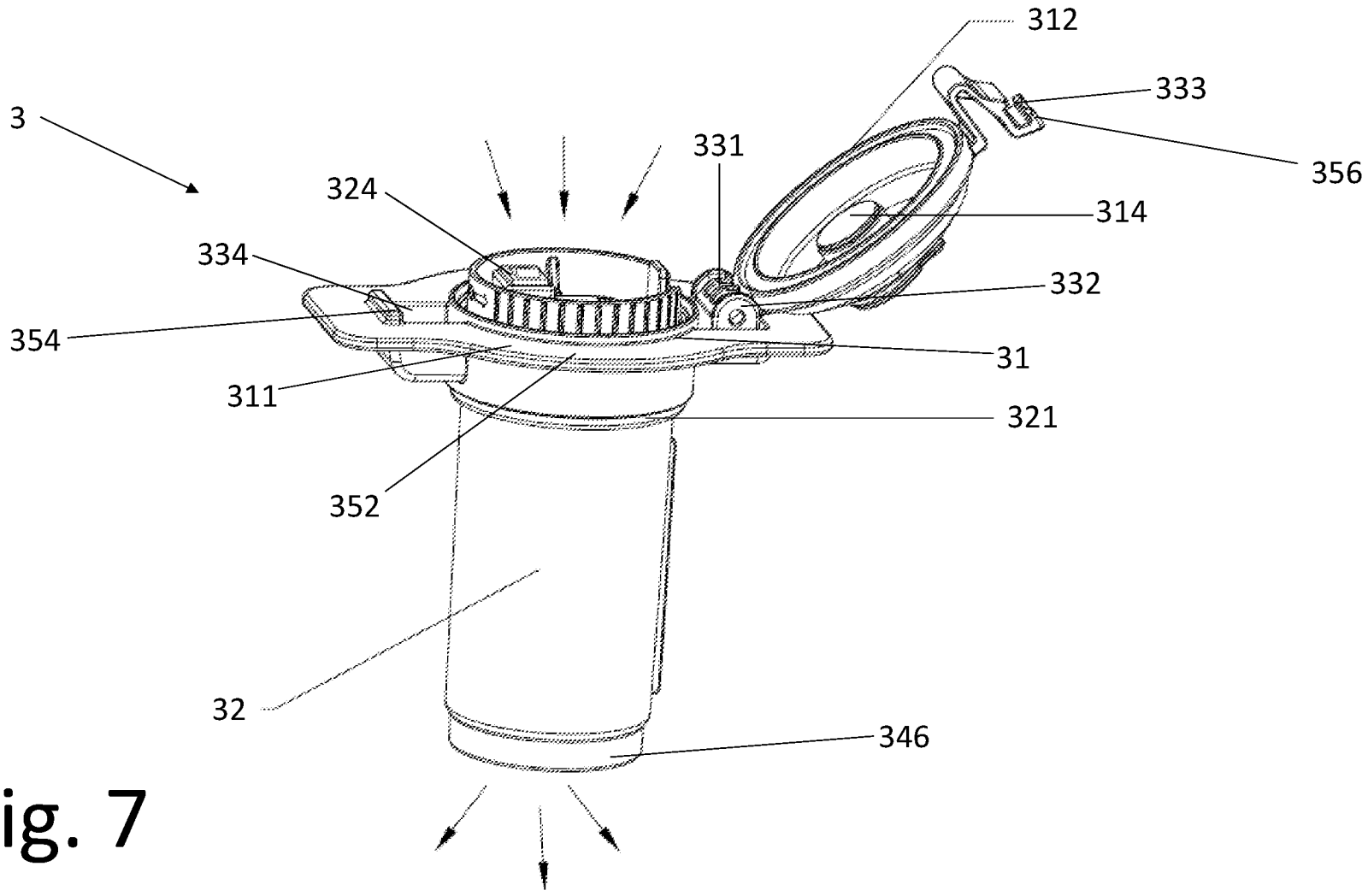
FIG. 7 is a perspective view of the electric air pump of the inflatable product shown in FIG. 1, in an inflation configuration.
Figure 8:
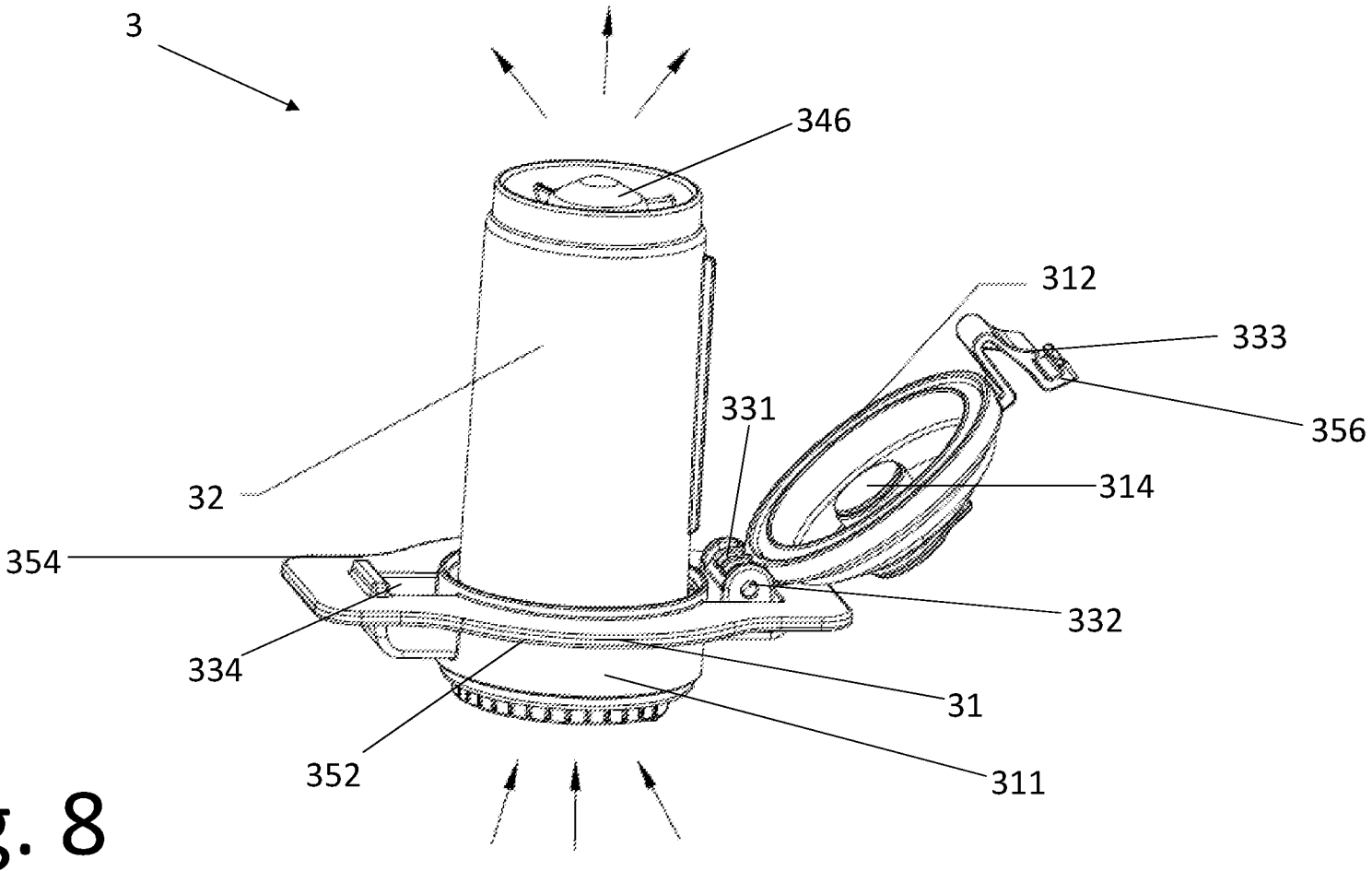
FIG. 8 is a perspective view of the electric air pump of the inflatable product shown in FIG. 1, shown in a deflation configuration.

When pump 32 is installed in the forward direction, the air outlet extends into the internal chamber of product body 11 as shown in FIGS. 7 and 11. When air pump 32 is installed in the reverse direction, the air inlet extends into the internal chamber of product body as shown in FIGS. 8 and 12. In this way, a user may easily reconfigure air pump 32 between the inflation configuration (FIGS. 7 and 11) and the deflation configuration (FIGS. 8 and 12).

Turning to FIGS. 7 and 11, when pump 32 is installed in a forward (inflation) direction, one end of pump 32 extends into the internal chamber of inflatable product 1 through aperture 351. The other end is sealed between valve base 311 and valve cover 312 by valve cover 312. This places pump 32 in the inflation configuration such that activation of the pump 32 pumps air into the internal chamber of inflatable product 1 to achieve inflation.

By contrast, FIGS. 8 and 12 show pump 32 installed in the reverse direction, one end of pump 32 extends into the internal chamber of inflatable product 1 through aperture 351, and the other end extends out of valve cover 312. This places pump 32 in the deflation configuration such that activation of the pump 32 pumps the air in the internal chamber of the inflatable product 1 out to the external environment. Because pump 32 can be disassembled from valve 31, pump 32 can be easily reconfigured between the inflation configuration to the deflation configuration, thereby achieving rapid inflation or rapid deflation of the inflatable product 1.

As discussed above, in order to control pump 32, pump 32 includes switch 324, and valve cover 312 includes a trigger member that cooperates with switch 324. When valve cover 312 is in the closed configuration, the trigger member contacts switch 324 to turn off switch 324, and pump 32 automatically stops working. The trigger element may be a pressure block positioned to turn off switch 324 by using a squeezing force between the pressure block and switch 324.

When valve cover 312 is in the opened configuration, the pressing force disappears, and switch 324 is turned on again. Therefore, when pump 32 is installed in valve 31, as long as valve cover 312 is in the opened configuration, pump 32 automatically starts to inflate. When the user closes valve cover 312, pump 32 will automatically stop inflation.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. An inflatable product comprising:

a product body defining a primary inflatable chamber and having an electric pump aperture and an auxiliary air supply aperture formed therein;

an electric air pump mounted on the product body through the electric pump aperture, the electric air pump including a valve; and an auxiliary air supply mounted to the product body at the auxiliary air supply aperture, the auxiliary air supply defining an auxiliary air supply chamber defining an internal air volume nominally separate from, but contained within, the primary inflatable chamber of the product body;

wherein:

the valve includes a valve base having an aperture therethrough and a valve cover configured to open or close the aperture; and the valve cover includes an air inlet formed therethrough and a check valve disposed in the air inlet configured to admit air into an interior of the inflatable product body and to block air from flowing out from the interior of the inflatable product body.

2. The inflatable product of claim 1, wherein the valve cover is pivotably attached to the valve base and includes a clip adapted to removably lockingly engage a clip retainer formed on the valve base.

3. The inflatable product of claim 1, wherein the electric air pump further comprises:

a switch;

a power source operably coupled to the switch;

a motor operably coupled to the power source via the switch; and a housing which contains at least the power source and the motor.

4. The inflatable product of claim 1, wherein the product body defines a nominal air capacity;

the electric air pump is configured to inflate the inflatable product from a deflated state to a partially inflated state in which the inflatable product body contains between 95.0% and 99.5% of the nominal air capacity, and the auxiliary air supply is configured to inflate the inflatable product from the partially inflated state to a fully inflated state by providing the final 0.5-5.0% of the nominal air capacity.

5. The inflatable product of claim 1, wherein the electric air pump delivers a maximum pressure between 15-25 mm water column, whereby the electric air pump is a low-pressure design, and the auxiliary air supply is configured to deliver a pressure between 160-200 mm water column.

6. The inflatable product of claim 1, wherein the inflatable product is a mattress having bottom and top sheets designed to provide ground-contacting and sleeping surfaces, and a sidewall joined to peripheral edges of the top and bottom sheets.

7. The inflatable product of claim 6, wherein the electric air pump aperture is formed in the sidewall of the mattress, and the auxiliary air supply aperture is formed in one of the top and bottom sheets.

8. The inflatable product of claim 1, wherein the product body defines a nominal air capacity;

the electric air pump is configured to inflate the inflatable product from a deflated state to a partially inflated state, and the auxiliary air supply is configured to inflate the inflatable product from the partially inflated state to a fully inflated state.

9. An inflatable product comprising:

a product body defining a primary inflatable chamber and having an electric pump aperture and an auxiliary air supply aperture formed therein;

an electric air pump mounted on the product body through the electric pump aperture, the electric air pump including a valve;

an auxiliary air supply mounted to the product body at the auxiliary air supply aperture, the auxiliary air supply defining an auxiliary air supply chamber defining an internal air volume nominally separate from, but contained within, the primary inflatable chamber of the product body;

a housing; and a pump detachably coupled to the valve in an inflation configuration in which the pump is operable to transmit air into an interior of the inflatable product body, and a deflation configuration in which the pump is operable to transmit air out of the interior of the inflatable product body;

wherein:

the valve includes a valve base having an aperture therethrough and a valve cover configured to open and close the aperture;

the housing includes a peg extending radially outward therefrom; and the valve base of the valve includes a mounting groove sized to receive the peg and configured to selectively couple the electric air pump in the inflation configuration and the deflation configuration.

10. The inflatable product of claim 9, wherein:

the mounting groove includes a first portion configured to guide the housing through the aperture along an axial direction; and the mounting groove includes a second portion configured to guide the housing through a rotation within the aperture.

11. The inflatable product of claim 10, wherein the second portion includes a locking protrusion positioned to removably capture the peg.

12. The inflatable product of claim 9, wherein the electric air pump further comprises:

a switch;

a power source operably coupled to the switch; and a motor operable coupled to the power source via the switch.

13. The inflatable product of claim 12, wherein the housing contains at least the power source and the motor.

14. The inflatable product of claim 9, wherein the product body defines a nominal air capacity;

the electric air pump is configured to inflate the inflatable product from a deflated state to a partially inflated state in which the inflatable product body contains between 95.0% and 99.5% of the nominal air capacity, and the auxiliary air supply is configured to inflate the inflatable product from the partially inflated state to a fully inflated state by providing the final 0.5-5.0% of the nominal air capacity.

15. The inflatable product of claim 9, wherein the electric air pump delivers a maximum pressure between 15-25 mm water column, whereby the electric air pump is a low-pressure design, and the auxiliary air supply is configured to deliver a pressure between 160-200 mm water column.

16. The inflatable product of claim 9, wherein the inflatable product is a mattress having bottom and top sheets designed to provide ground-contacting and sleeping surfaces, and a sidewall joined to peripheral edges of the top and bottom sheets.

17. The inflatable product of claim 16, wherein the electric air pump aperture is formed in the sidewall of the mattress, and the auxiliary air supply aperture is formed in one of the top and bottom sheets.

18. The inflatable product of claim 9, wherein the product body defines a nominal air capacity;

the electric air pump is configured to inflate the inflatable product from a deflated state to a partially inflated state, and the auxiliary air supply is configured to inflate the inflatable product from the partially inflated state to a fully inflated state.

* * * * *